US005877588A

United States Patent [19]

Kaftanov et al.

[11] Patent Number: 5,877,588

[45] Date of Patent: Mar. 2, 1999

[54] FIELD EMISSION CATHODE AND A LIGHT SOURCE INCLUDING A FIELD EMISSION CATHODE

[75] Inventors: Vitaly Sergeevich Kaftanov, Moscow; Alexander Leonidovich Suvorov, Moscow; Evgenij Pavlovich Sheshin, Moscow, all of Russian Federation; Jan Olsfors, Le Vaud, Switzerland

[73] Assignee: Lightlab AB, Stockholm, Switzerland

[21] Appl. No.: 904,652

[22] Filed: Aug. 1, 1997

[30] Foreign Application Priority Data

Jun. 13, 1997 [CH] Switzerland ..... 9702276

[51] Int. Cl.[6] ..... H01J 1/30; H01J 19/24

[52] U.S. Cl. ..... 313/491; 313/632; 313/309; 445/51

[58] Field of Search ..... 313/491, 631, 313/632, 309, 336, 351, 422, 496, 308, 310; 445/49, 50, 51; 315/169.1, 169.4

[56] References Cited

U.S. PATENT DOCUMENTS

| | | | |
|---|---|---|---|
| 4,272,699 | 6/1981 | Faubel et al. | 313/360 |
| 5,588,893 | 12/1996 | Kaftanov et al. | 445/50 |
| 5,603,649 | 2/1997 | Zimmerman | 445/24 |
| 5,764,004 | 6/1998 | Rabinowitz | 315/169.1 |

FOREIGN PATENT DOCUMENTS

| | | | |
|---|---|---|---|
| 40 02 049 | 7/1991 | Germany | H01J 3/02 |
| 2 070 849 | 9/1981 | United Kingdom | H01J 63/06 |
| 2 089 561 | 6/1982 | United Kingdom | H01J 63/06 |
| 2 097 181 | 10/1982 | United Kingdom | H01J 63/06 |
| 2 126 006 | 3/1984 | United Kingdom | H01J 63/06 |
| WO96/25753 | 8/1996 | WIPO | H01J 1/30 |
| WO9707531 | 2/1997 | WIPO | H01J 63/06 |

*Primary Examiner*—Sandra O'Shea
*Assistant Examiner*—Michael Day
*Attorney, Agent, or Firm*—Jacobson, Price, Holman & Stern, PLLC

[57] ABSTRACT

A field emission cathode (40) includes field emitting bodies (42) in the form of fibers, and a base body having a longitudinally extending core (41) formed by at least two wires (43) between which the fibers are secured. The fibers are distributed along at least a part of the length of the core (41) and extend radially outwards from the core. A light source (10) includes an evacuated container having walls at least a portion of which consists of an outer glass layer (23) on which at least a major part thereof is coated on the inside with a layer of phosphor (24) forming a luminescent layer, and a conductive layer forming an anode (25). The layer of phosphor (24) is excited to luminescence by electron bombardment from a field emission cathode (40) located in the interior of the container, and a modulator electrode or grid (30) is arranged between the cathode (40) and the anode (25) for creating an electric field for the emission of electrons. The field emission cathode (40) includes field emitting bodies (42) in the form of fibers, and a base body having a longitudinally extending core (41) formed by at least two wires (43) between which the fibers are secured.

22 Claims, 2 Drawing Sheets

10
20
21
22
30
32
33
40
41
42
43
50
51
52
53
54
60

FIELD EMISSION CATHODE AND A LIGHT SOURCE INCLUDING A FIELD EMISSION CATHODE

FIELD OF THE INVENTION

The present invention relates to a field emission cathode, especially for use in a light source for illumination purposes, including a base body, and field emitting bodies in the form of fibers, attached to the base body. Further, the present invention relates to a light source, especially for illumination, comprising an evacuated container having walls, at least a portion of which consists of an outer glass layer which on at least a major part thereof is coated on the inside with a layer of phosphor forming a luminescent layer and a conductive layer forming an anode, which layer of phosphor is excited to luminescence by electron bombardment from a field emission cathode located in the interior of the container, a modulator electrode being arranged between the cathode and the anode for creating an electrical field necessary for the emission of electrons, the field emission cathode including a base body, and field emitting bodies in the form of fibers, attached to the base body, wherein said fibers have field emitting surfaces at their free ends.

BACKGROUND OF THE INVENTION

A field emission cathode of this kind is disclosed in U.S. Pat. No. 5,588,893 (Kentucky Research and Investment company Limited). The cathode disclosed includes carbon fibers, arranged in bundles, preferably in a matrix, on a substrate. The document also discloses a method including treatment of the emitting surfaces in order to achieve a cathode with higher efficiency than previous cathodes. This cathode is considered to be the prior art closest to the invention concerning a cathode. The content of U.S. Pat. No. 5,588,893 is incorporated herein by reference.

Further, DE, C2, 40 02 049 (Deutsche Forschnungsanstalt für Luft- und Raumfahrt e.V.) discloses an electron emitting source including a cathode which comprises small, felted or fabric plates, spaced apart from each other. The plates can consist of felted carbon fibers, and be arranged on a cylindrical cathode body. The use is for irradiating a medium with electrons.

U.S. Pat. No. 4,272,699 (Max-Planck-Gesellschaft zur Forderung der Wizsenschaften e.V.) discloses a field emission cathode in an electron impact ion source for an instrument such as a mass spectrometer or molecular beam detector. Thc cathode has angular configuration, and includes bundles of carbon fibers, with their emitting surfaces directed inwards.

Previously known field emission cathodes are often of a Complicated and fragile construction, especially as concerns the mountings and the attachment of field emitting bodies.

It has been found in connection with cathodes including fibers that the electrical fields acting between the cathode and a grid or an anode will cause individual fibers to get loose from their carrier if they are not safely secured thereto. Once loose, the fibers will, in most cases, be attracted by the grid and cause a short circuit between the cathode and the grid, until it burns off after some time due to the resulting current through the fiber.

The above mentioned U.S. Pat. No. 5,588,893 (Kentucky Research and Investment Company Limited) also discloses a light source of the kind mentioned above. A cathode is arranged inside an evacuated glass container having a luminescent layer arranged on its inner surface. A modulator is provided between the cathode and the luminescent layer. This light source is considered to be the prior art closest to the invention concerning a light source. However, the cathode of the previously known light source has the drawbacks discussed above.

Other light sources, including an evacuated envelope containing a grid and a heated cathode, for emission of electrons, are known form GB, A, 2 070 849 (The General Electric Company Limited), GB, A, 2 097 181 (The General Electric Company PLC), GB, A, 2 126 006 (The General Electric Company plc) and GB, A, 2 089 561 (The General Electric Company Limited). The insides of the envelopes are covered with a layer of phosphor of an electron-responsive type.

Since these light sources all have a heated cathode, the cathode has to be heated by special means, before the emission of light starts.

SUMMARY OF THE INVENTION

It is an object of the invention to provide a field emission cathode and a light source, respectively, having a long life, with high efficiency and stability, which can be produced at low cost.

These and other objects are attained by the features set forth in the appended claims.

By the features in claim 1, further, a field emitting cathode of simple and robust construction is obtained By the features in claims 2, 4, 5, 6, and 7, a field emitting cathode is obtained which further provides for a high emission and uniform distribution of emitted electrons, in particular through a cylindrical surface region surrounding the cathode. A cathode with less interference between the field emitting surfaces is also achieved.

By the features in claims 3, 8 and 9, a field emitting cathode is achieved, which further provides for a more efficient emission of electrons.

By the features in claim 6, a field emitting cathode is achieved, which further provides for a more stable emission of electrons minimizing the risk of fibers getting loose and adversely affect the operation. Through the arrangement in claim 6, the forces acting upon each fiber due to the electrical fields are essentially equal on each of the two parts of the fibers extending from the core.

By the features in claim 10, further, a light source without a starting up period is achieved, i.e. when the power is turned on, the light starts immediately, thanks to the use of a field emission cathode. A light source with no need for materials having negative environmental effects is also achieved By the features in claim 11, further, a light source having a large active light emitting surface with relatively low activity per square unit is achieved. this efficient use of the surface renders it possible to achieve an efficient light source having a high light emission in relation to the heat produced.

By the features in claim 12, further, a light source having a high and uniforn light emission is achieved.

By the features in claim 13, further, a light source having a improved light emission is achieved.

By the features in claim 14, further, a light source operating at lower voltages is achieved.

By the features in claims 15–22, further, a light source having a high and uniform light emission is achieved.

DESCRIPTION OF THE PREFERRED EMBODIMENT

Figures 1, 2, 3, 4, 5, 6:
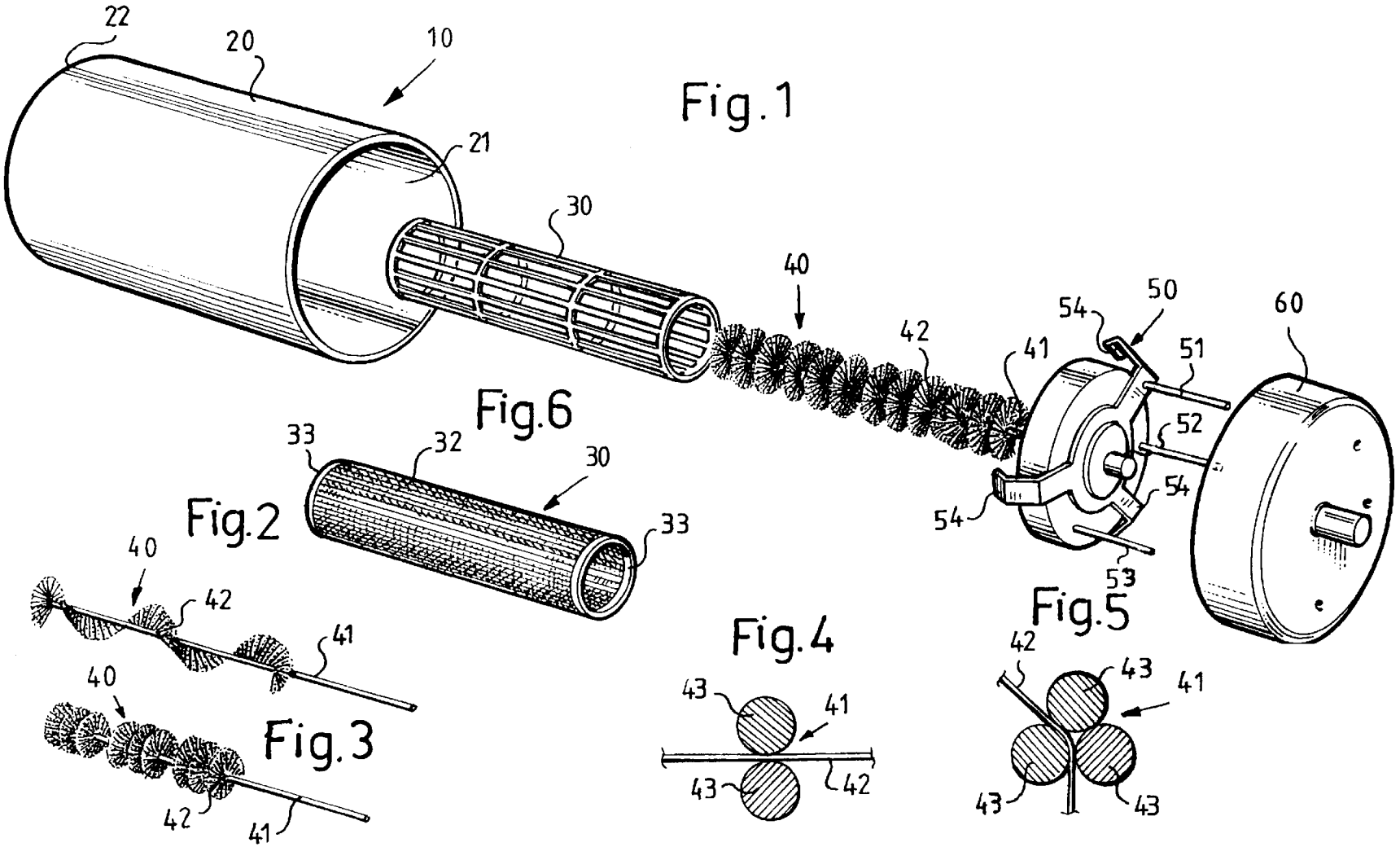
FIG. 1 is an exploded view of an embodiment of a light source according to the present invention.
FIG. 2 is a view of an embodiment of a cathode according to the present invention.
FIG. 3 is a view of an alternative embodiment of a cathode according to the present invention.
FIG. 4 is a cross section of a cathode according to the invention.
FIG. 5 is a cross section of an alternative cathode according to the invention.
FIG. 6 is a view of a modulator electrode or grid

Referring to FIG. 1, there is shown, in an exploded view an embodiment of a light source according to the present invention, identified generally by the numeral 10. and especially intended for illumination purposes. it includes a container having walls, one of which is identified by the numeral 20. This wall 20 has an outer glass layer and is shown to be cylindrical. The cylinder 20 has an open end 21 which is covered by an end cap 60. A sealing (not shown) is provided between the end cap and the cylinder 20, in order to achieve an air-tight sealing of the container. At the other end 22 of the cylinder 20 there can be arranged a circular wall as a continuation of the cylinder wall 20, also having an outer layer of glass. Alternatively, the end 22 can be open and provided with an end cap similar to the one arranged at the end 21, also provided with a sealing. The container is sealed in order to maintain the vacuum created when the container is evacuated.

Inside the container, a modulator electrode or grid 30 is arranged. It is preferably cylindrical and arranged coaxially with the container wall 20. The construction and the function of this modulator electrode or grid 30 will be explained further below.

Inside the modulator electrode or grid and preferably coaxially therewith, a cathode 40 is arranged. This cathode is a cold cathode, especially a field emission cathode. Its construction and function will be explained further below.

The light source also includes a fitting 50 provided with electrical connections 51–54. The fitting 50 further includes means (not shown) for fastening of the cathode 40 and the modulator electrode or grid 30. Those can be soldered to the fitting 50 or they can be adhered to the fitting 50 by an adhesive, preferably an electrically conducting adhesive. They could also be clamped to the fitting 50 by a clamping means or gripped by a gripping means. Electrical connection means (not shown) are also provided on the fitting for connecting the cathode 40 and the modulator electrode or grid 30, respectively. Those connection means are provided with conductive terminal pins 52, 53 which extend through the fitting and are insulated from each other. A further terminal pin 51 is connected to a conductive means provided with conductive fingers or similar 54, which in the assembled state of the light source are in contact with a conductive layer 25 provided inside the container, which will be further described below. The terminal pins 51–53 all extend through the end cap, which is provided with openings therefore. The terminal pins 51–53 are electrically insulated from each other, and the corresponding openings in the end cap 60 are air-tight sealed. At the other end 22 of the container wall 20, there can be arranged a fitting similar to the fitting 50, to support the cathode 40 and the modulator electrode or grid 30. However, this fitting, at the other end 22, could be formed without electrical connection means. An end cap similar to the end cap 60 arranged at the end 21, also provided with a sealing, is preferably arranged to cover the fitting at the other end 22. Of course, if the fitting is not provided with electrical connection means, the corresponding end cap should not be provided with feed-through openings. As an alternative to arranging a fitting, which supports the cathode 40 and the modulator electrode or grid 30 at the other end 22, an end cap similar to the end cap 60 can itself be provided with supporting, fastening or gripping means for the cathode 40 and the modulator electrode or grid 30. It is also possible that a circular wall, which is a continuation of the cylinder wall 20, is provided with supporting, fastening or gripping means. A further alternative is that the cathode 40 and the modulator electrode or grid 30 are self-supporting and fastened in such a way to the fitting 50 that there is no need for a support or fastening means at the other end.

One embodiment of a cathode 40 is shown in FIG. 1. However, the cathode can be formed in various other ways, two of which are shown in FIGS. 2 and 3. The cathodes shown in FIGS. 1, 2 and 3 all include a longitudinally extending core having a central axis, and field emitting bodies 42 extending from the core. The field emitting bodies 42 are elongate and are distributed along at least a part of the length of the core 41. In the embodiments shown, the field emitting bodies 42 are fibers which extend radially outwards from the core and have free ends provided with field emitting surfaces. Preferably, the fibers are commercially available polyacrylnitrile carbon fibers, or other suited material containing carbon, and having a diameter in the range of a few microns ($\mu$m). By the use of carbon fibers it is sufficient with a moderate vacuum in the container. The fibers have irregularities at the field emitting surfaces, and to improve the field emission capacity, the field emitting surfaces will undergo a treatment, before the assembling of the cathode. This treatment includes the steps of modifying said field emitting surfaces by applying to said fibers a variable electric field, in order to induce electron field emission from said emitting surfaces, and increasing said variable electric field, in such a manner that a deterioration of said irregularities of said field emitting surfaces is limited.

In FIG. 4, which is a cross section of a cathode according to the invention, it is illustrated that the core can consist of two wires 43. It is shown how one of the fibers 42 is secured between the two wires of the core. Along the core, thousands or hundreds of fibers are secured between the wires. To secure the fibers even better to the core, an adhesive acting between the core and the fibers may be used. The adhesive used is preferably electrically conductive. Alternatively, if the wires 43 are twisted, the resulting clamping force between the wires 43 will safely secure the fibers 42 to the core 41. If the wires are twisted, the fibers 42 will extend from the core in a helical pattern.

In another embodiment, shown in FIG. 5, the core 41 consists of three wires. Each fiber 42 is bent in a curve around one of the wires. The wires 43 are preferably twisted and the resulting clamping force will secure the fiber in a favorable manner through the bending of the fiber. Even when the core is formed by two or more twisted wires, an adhesive may be used. The wires 43 are made of an electrically conducting material e.g. copper, steel or other suited material, and preferably with a diameter sufficient for the core to remain in the twisted state after the twisting operation without any external force acting on the core. The fibers 42 are preferably secured to the core at their central portions so that the length of each fiber extending from the core is essentially equal on each side. The fibers preferably have essentially the same length. As seen in FIGS. 1–3, the fibers 42 of the cathodes extend from the respective core in a helical pattern. In FIG. 1 and 2, this pattern is continuous, but the pitches of the helixes are different. In the cathode illustrated in FIG. 3, the helical pattern is interrupted so as to leave regions of the core without any fibers. Further, by choosing the pitch of the twisted wires, the distribution and the uniformity of the fibers, and thereby the field emitting surfaces, can be controlled.

The modulator electrode or grid 30 can be formed in various ways, whereof a first one is illustrated in FIG. 1 and a second one is illustrated in FIG. 6. However, it is preferred that the modulator electrode is cylindrical in order to achieve essentially the same distance between the modulator electrode and the field emitting surfaces of the fibers. The modulator electrode shown in FIG. 1 is a cage-like electrode having an essentially cylindrical form. The modulator electrode shown in FIG. 6 is preferably of metal wire-mesh supported by two rings, preferably of metal, one at each end. As understood by a person skilled in the art, there are many other ways to form the modulator electrode. For example, the modulator electrode can be supported by two insulating bodies, each in the form of a ring or a plate having a disc-like shape and being attached to the core of the cathode, or to tho fitting 50, or to other fittings, or to an end cap. Between the insulating bodies, and in parallel to the core of the cathode, metal wires can be arranged so as to be distributed around the circumference of the rings or the disc-shaped plates. The wires are connected to each other at the region of the rings or disc-shaped plates. The material of the modulator electrode can be any suitable electrically conductive material that is used for manufacturing grids.

Figure 7:
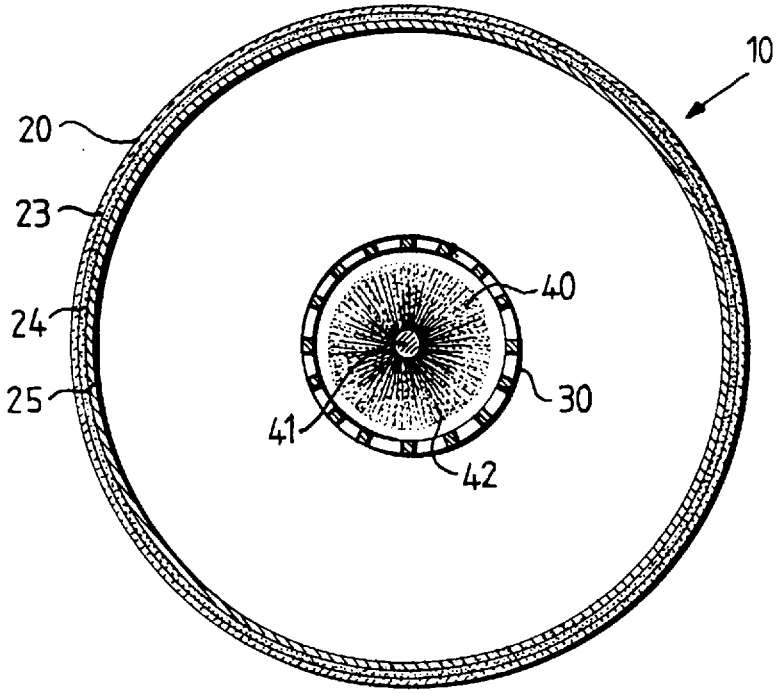
FIG. 7 shows a light source, according to the invention, in cross section.

FIG. 7 shows the light source in assembled state in cross section. As illustrated, the field emitting cathode 40 with its core 41 is placed in the center. The fibers extend radially outwards from the core in different directions exhibiting field emitting surfaces at their ends. The modulator electrode or grid 30 surrounds the cathode, with a distance between the field emitting surfaces of the fibers and the modulator electrode. This distance depends on the voltages to be supplied to the components and on the structure and composition of the field emitting bodies and their field emitting surfaces. However, the distance should be in the range of millimeters, for example 0.5–2 mm. To provide for a stable operation, the fibers are preferably of equal length, and the diameter of the cathode should be in the range of some millimeters up to a centimeter or more. For example, the diameter of a cathode may be 6–8 mm.

The cylindrical part 20 of the container walls surrounds the cathode 40 and the modulator electrode or grid 30. The cylindrical wall 20 consists of an outer glass layer 23, a phosphor layer 24 (a cathodoluminescent phosphor) and an inner conductive layer 25 forming an anode. The phosphor layer is a luminescent layer which upon electron bombardment emits visible light. The anode is preferably made of a reflecting, electrically conductive material, e.g. aluminum. The conductive fingers 54 are preferably in direct electrical contact with the anode 25. By arranging an aluminum layer covering the phosphor layer, adverse effects on the vacuum by possible evaporation of the phosphor are avioded.

In operation, a first voltage is supplied between the cathode 40 and the modulator electrode or grid 30, and a second voltage is applied between the cathode 40 and the anode 25. The second voltage is higher than the first voltage. The voltages are supplied from a feed and control circuit (not shown), which could be located in a housing, connected to the mains e.g. through an ordinary lamp socket. The feed and control circuit supplies the voltages to the conductive terminal pins 51–53, to which it is connected. When the voltages are applied, an electrical field is created between the cathode 40 and the modulator electrode or grid 30. This field should be of sufficient strength to cause field emission of electrons from the field emitting surfaces of the field emitting cathode 40. The electrons will accelerate and pass through the holes or openings of the modulator electrode or grid 30 and further on towards the anode 25. This movement of the electrons towards the anode 25 is caused by the kinetic energy of the electrons when they leave the region of the modulator electrode or grid 30, and by the electrical field present between the modulator electrode or grid 30 and the anode 25. Since the electrons have high kinetic energy and the anode layer is relatively thin (order of magnitude microns ($\mu$m)), they will pass through the anode so as to enter the phosphor layer while still having sufficient kinetic energy to excite the phosphor to luminescence, whereby visible light is emitted. The electrons will then return to the anode to be drained off. The electron bombardment will cause, besides light, heating of the cylinder wall 20. The glass layer will provide for the dissipation of the heat. The voltages applied depend on the materials used, the structures of the cathode, and the modulator electrode or grid 30. The voltages are in the range of kV where the first voltage is a few kV, e.g., 1.5 kV, and the second voltage some kV, typically about 4–6 kV. The second voltage much depends on the type of phosphor used. New types of phosphor are continuously developed and because of that, the voltage must be adapted to the specific type of phosphor used. Changing the type of phosphor and thereby the voltages will cause changes in the currents and the heating of the cylinder wall.

Figure 8:
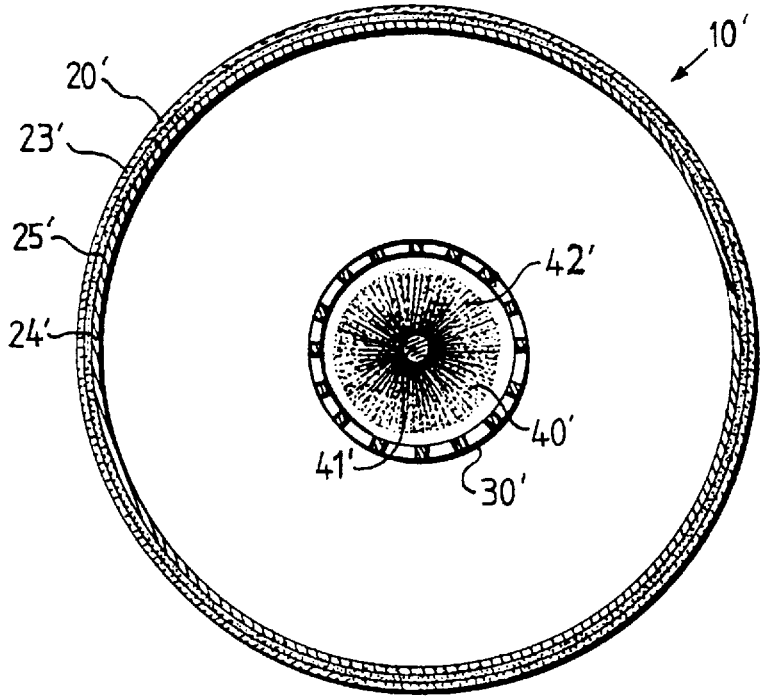
FIG. 8 shows an alternative light source, according to the invention, in cross section.

FIG. 8 shows an alternative embodiment of a light source, according to the invention, in assembled state and in cross section. The cathode 40' and the modulator electrode 30' are essentially the same as in FIG. 7. What differs from FIG. 7 is the arrangement of the layers of the wall 20'. It includes an outer glass layer 23', which is covered, on at least a major part of its inside, by an electrically conductive transparent material forming the anode 25'. The anode 25' then carries the phosphor layer 24' on the inside. The anode is made from e.g. tin oxide or indium oxide. To make it possible for the conductive fingers 54 to establish direct electrical contact with the anode 25', some regions of the anode 25' are not covered with phosphor. Alternatively, electrically conductive surfaces being in contact with the anode can be applied on to the phosphor layer. Those surfaces are small not to interfere with the operation of the light source but of sufficient size to establish electrical contact with the conductive fingers 54.

The operation of this embodiment illustrated in FIG. 8 is essentially the same as that of the embodiment illustrated in FIG. 7. However, after leaving the region of the modulator electrode or grid 30', the electrons will first hit the phosphor layer and excite it to luminescence, and thereafter they will be drained off by the anode. Since the electrons first hit the phosphor layer and do not have to pass through the anode layer before they hit the phosphor layer, the voltage applied between the cathode and the anode can be about 1–2 kV lower than in the embodiment illustrated in FIG. 7.

Although the invention is described by means of the above examples, naturally, a skilled person would appreciate that many other variations than those explicitly disclosed are possible within the scope of the claim. For example the cathode is not limited to be used in a light source.

It should be noted that although the embodiments include certain details for the electrical connection and for the support of the parts in the light source, those can be formed in many other ways, as appreciated by a person skilled in the art, and do not limit the scope of invention.

We claim:

1. A field emission cathode, including a base body, and field emitting bodies in the form of fibers, attached to the base body, wherein:

said fibers have field emitting surfaces at their free ends, the base body is a longitudinally extending core formed by at least two wires between which the fibers are secured, said fibers are distributed along at least a part of the length of the core and extend radially outwards from the core.

2. A field emission cathode according to claim 1, wherein the wires forming the core are twisted together so as to provide a clamping force holding the fibers in well-defined positions.

3. A field emission cathode according to claim 1, wherein said fibers are carbon fibers.

4. A field emission cathode according to claim 2, wherein said fibers freely extend radially outwards from the core in different directions.

5. A field emission cathode according to claim 4, wherein the field emitting surfaces are essentially uniformly distributed around the core.

6. A field emission cathode according to claim 5, wherein each fiber is attached to the core at its central portion and exhibits two free ends, each constituting a field emitting surface.

7. A field emission cathode according to claim 6, wherein the fibers have essentially the same length.

8. A field emission cathode according to claim 7, wherein said fibers are carbon fibers.

9. A field emission cathode according to claim 8, wherein said fibers, having irregularities at said field emitting surfaces, are treated by the steps of:

modifying said field emitting surfaces by applying to said fibers a variable electric field, in order to induce electron field emission from said emitting surfaces, and increasing said variable electric field, in such a manner that a deterioration of said irregularities of said field emitting surfaces is limited.

10. A light source, comprising an evacuated container having walls, at least a portion of which consists of an outer glass layer which on at least a major part thereof is coated on the inside with a layer of phosphor forming a luminescent layer and a conductive layer forming an anode, which layer of phosphor is excited to luminescence by electron bombardment from a field emission cathode located in the interior of the container, a modulator electrode being arranged between the cathode and the anode for creating an electrical field necessary for the emission of electrons, the field emission cathode including a base body, and field emitting bodies in the form of fibers, attached to the base body, wherein said fibers have field emitting surfaces at their free ends, wherein:

the base body is a longitudinally extending core formed by at least two wires between which the fibers are secured, said fibers are distributed along at least a part of the length of the core and extend radially outwards from the core.

11. A light source according to claim 10, wherein the container has a cylindrical shape.

12. A light source according to claim 11, wherein the modulator electrode includes a conductive, substantially cylindrical structure surrounding the field emission cathode.

13. A light source according to claim 11, wherein the luminescent layer is arranged between the glass layer and the anode, and the anode is made of a reflective material for reflection of the light emitted from the luminescent layer.

14. A light source according to claim 11, wherein the anode is arranged between the glass layer and the luminescent layer, did the anode is made of a transparent material.

15. A light source according to claim 12, wherein the wires forming the core are twisted together so as to provide a clamping force holding the fibers in well-defined positions.

16. A light source according to claim 15, wherein said fibers are carbon fibers.

17. A light source according to claim 15, wherein said fibers freely extend radially outwards from the core in different directions.

18. A light source according to claim 17, wherein the field emitting surfaces are essentially uniformly distributed around the core.

19. A light source according to claim 18, wherein each fiber is attached to the core at its central portion and exhibits two free ends, each constituting a field emitting surface.

20. A light source according to claim 19, wherein the fibers have essentially the same length.

21. A light source according to claim 20, wherein said fibers are carbon fibers.

22. A light source according to claim 21, wherein said fibers, having irregularities at said field emitting surfaces, are treated by the steps of:

modifying said field emitting surfaces by applying to said fibers a variable electric field, in order to induce electron field emission from said emitting surfaces, and increasing said variable electric field, in such a manner that a deterioration of said irregularities of said field emitting surfaces is limited.

* * * * *

UNITED STATES PATENT AND TRADEMARK OFFICE

CERTIFICATE OF CORRECTION

PATENT NO. : 5,877,588

DATED : March 2, 1999

INVENTOR(S) : Vitaly Sergeevich KAFTANOV et al

It is certified that error appears in the above-identified patent and that said Letters Patent is hereby corrected as shown below:

On the title page item [73] and [30], should read as follows:

[73] Assignee: Lightlab AB, Stockholm, Sweden

[30] Foreign Application Priority Data

June 13, 1997 [SE] Sweden .....9702276

Signed and Sealed this
First Day of February, 2000

Attest:

Q. TODD DICKINSON

Attesting Officer

Acting Commissioner of Patents and Trademarks